United States Patent [19]

Giuliani

[11] Patent Number: 4,797,978

[45] Date of Patent: Jan. 17, 1989

[54] MULTIPLE-CARD WITH TRANSFERRING, CARDING AND CLEANING CYLINDER

[76] Inventor: Marcello Giuliani, Via Cellerese No. 33, 50013 Campi Bisenzio, Italy

[21] Appl. No.: 76,019

[22] Filed: Jul. 21, 1987

[30] Foreign Application Priority Data

Jul. 24, 1986 [IT] Italy ..... 9445 A/86

[51] Int. Cl.[4] ..... D01G 15/40

[52] U.S. Cl. ..... 19/98; 19/107

[58] Field of Search ..... 19/98, 99, 105, 106 R, 19/107, 110, 111, 113

[56] References Cited

U.S. PATENT DOCUMENTS

| | | | |
|---|---|---|---|
| 2,115,605 | 4/1938 | Allen et al. | 19/99 |
| 2,603,840 | 7/1952 | Dunn | 19/107 X |
| 3,097,399 | 7/1963 | Alston | 19/98 |
| 4,128,917 | 12/1978 | Varga | 19/98 X |
| 4,300,267 | 11/1981 | Winch et al. | 19/107 X |
| 4,355,439 | 10/1982 | Estebanell | 19/107 X |
| 4,539,728 | 9/1985 | Portell | 19/107 X |

*Primary Examiner*—Louis K. Rimrodt

*Attorney, Agent, or Firm*—Hopgood, Calimafde, Kalil, Blaustein & Judlowe

[57] ABSTRACT

A multiple-card, so-called "tandem card" comprising, between the combing cylinder (doffer) of the first carding drum and the second carding drum, transfer means made up of doffing, carding and cleaning members which also arrange the fibres parallel to each other.

3 Claims, 1 Drawing Sheet

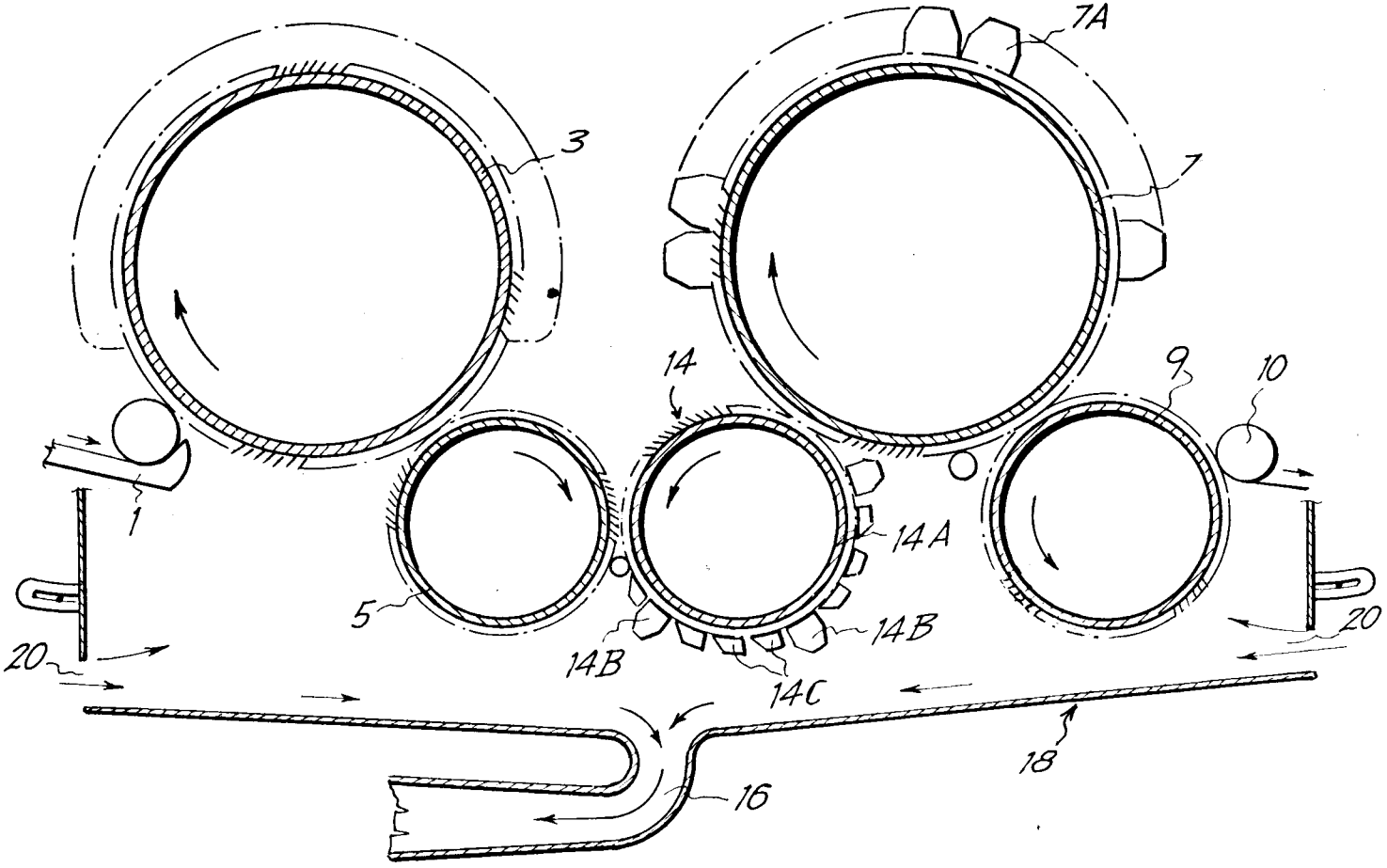
7A
7
3
10
9
14A
14B
14C
14
14B
5
1
20
20
18
16

MULTIPLE-CARD WITH TRANSFERRING, CARDING AND CLEANING CYLINDER

DESCRIPTION

The invention relates to an improvement in a multiple-card, so-called "tandem card", that is, a card comprising a first carding drum and a second cascade-arranged carding drum, a first combing cylinder (doffer) for the first carding drum, a second combing cyliner for the second carding drum, and transfer means between said first combing cylinder and said second carding drum.

According to the invention, these transfer means are made up of doffing, carding and cleaning members which arrange the fibres parallel to each other.

Practically, said doffing, carding and cleaning members are made up of at least a cylinder with clothing having the function of carding and thinning the fibres and of arranging them parallel to each other. Preferably, said cylinder with clothing is located below the comber and the second carding drum, and cleaning blades associated therewith are located in the lower zone, in order to achieve the cleaning by gravity and by suction from below, besides by the centrifugal effect. Said cylinder with clothing, equipped with cleaning blades, may even replace the rotating caps (or flats) necessarily provided in the second carding drum of the traditional multiple-cards.

All the present-day existing multiple-cards, called "tandem cards", are provided with a cylinder which is exclusively of transfer type and is intended for the transfer of the fibres from the doffer or comber of the first card to the drum of the second card. For the transfer of said fibres a second cylinder may also be provided, according to the running motion of the doffer. In any case, said members, being merely transfer means, have no carding member to arrange the fibres in parallel during the motion.

The invention—as above defined—provides the transfer means—according to the motion of the doffer—with the possibility of being combined with carding and cleaning members, allowing said transfer means to become in practice a third carding drum. This permits the fibres to be perfectly thinned while arranging them parallel to each other during the transfer step from the doffer of the first carding drum to the second carding drum, and also permits the cleaning of the material fed to the drum of the next card. During the transfer of the fibres, disposed perfectly parallel to each other and perfectly thinned, cleaning blades are in fact also provided which are interposed between the carding members; such blades, suitably registered and properly spaced apart and being inserted below the carding member which transfers the fibres, clean same fibres by moving away foreign particles, including the so-called cotton "shells", by centrifugal and gravity effect. All these impurities or particles fall directly, with no provision for other members, onto the underlying suction zone of the card.

The transferred, parallel and clean fibres, driven into the drum of the traditional second card, allow the machine to increase its output, to improve the quality of the ribbon and, consequently, of the finished product, to the point—if wanted—that the usual rotating caps or cleaning means of the presentday cards are no longer necessary for the cleaning of the fibre.

The invention will be better understood by following the description and the attached drawing, which shows a practical non-limitative exemplification of same invention. The drawing shows a schematic side view of the 'tandem card' according to the invention.

According to what is illustrated in the attached drawing, numeral 1 generally indicates a group for feeding of the material to be worked, said material being fed to a first carding drum 3 of a type known per se. With said carding drum 3, a doffer or combing cylinder 5 cooperates, capable of doffing the material out of the clothing of the carding drum 3 in order to feed it to the second carding drum 7 through a transfer means. The material is doffed from the second carding drum by a comber 9, from which the same material is discharged by means of a comb 10 of traditional type.

Each of the two drums 3 and 7 will be equipped with an assembly of peripheral working and cleaning units like the so-called "caps" or with a set of working and doffing cylinders.

According to the invention, a doffing, carding and cleaning member 14 is provided as a transfer means between the doffer 5 and the drum 7, which is also able to arrange the fibres parallel to each other. Practically, a cylinder 14A with clothings may be provided, being combined in its lower part with caps 14B and cleaning blades 14C. The thus realized group 14 ensures the cleaning of the material fed thereto by the doffer 5, allows the doffing and carding of the fibres and also ensures the parallel arrangement of same fibres, that is, a kind of combing of the fibres. The impurities and the foreign particles separated by the members 14B, 14C are removed both by centrifugal effect and gravity, their detachment and removal being facilitated by the suction effect in the lower part of the carding group, as provided by solutions already suggested by the same applicant. In particular, a transverse suction slot 16 is provided at the centre of a casing 18 with apertures 20 for the air admission.

The arrows indicate the rotation direction of the individual cylinders, and the speeds are such as to consent the discharge of drum 3 by the cylinder 5, of the cylinder 5—directly or indirectly—by the cylinder 14A, and the transfer of the material from cylinder 14A to the drum 7. The comber 9 doffs the drum 7 and yields, in turn, the web to comb 10. The cylinder 5 may also rotate in the direction opposite to that indicated in the drawing. An example of embodiment may provide peripheral, that is, surface speeds of the following values: about 1800 m per minute for drums 3 and 7; about 200 m per minute for combers 5 and 9; about 800–1000 m per minute for cylinder 14A.

The group 14, 14A, 14B, 14C is able to clean the fibres to such a degree that the second carding drum 7 need no longer be provided with rotating caps, that is, of the type permitting the cyclic cleaning of their own operating members; therefore, said second carding drum 7 may be equipped with the simplest fixed carding caps 7A. The clothing of said second carding drum 7 has a far longer life than that of the traditional cards, because it receives fibres from the group 14, 14A, 14B, 14C, already devoid of impurities and clots.

It is understood that the drawing shows an exemplification given only as a practical demonstration of the invention, as this may vary in forms and dispositions without nevertheless departing from the scope of the concept on which the same invention is based. Transfer members may be provided, for example, between the doffer 5 and cylinder 14A and between the latter and drum 7, and two or more groups 14 in series may possibly be provided as well.

I claim:

1. A multiple-card, so called "tandem card" for cleaning fibers, comprising:

a first carding drum (3) and a second cascade-arranged carding drum (7), and including a first combing cylinder (doffer) (5) for the first carding drum, and a second combing cyliner (9) for the second carding drum, transfer means between said first combing cylinder and said second carding drum consisting essentially of at least one cylinder (14) for further doffing, carding and cleaning fibers fed thereto, said at least one cylinder (14) having a clothing (14A) for carding, thinning and cleaning and arranging said fibers in parallel and having cooperably associated therewith caps or flats (14B) and cleaning blades (14C), said at least one cylinder (14) being disposed in a zone below said carding drums (3) and (7), at which zone cleaning of the fibers is effected by gravity and centrifugal force.

2. The multiple card as in claim 1, wherein said zone is provided with suction means for removing material cleaned from said fibers.

3. The multiple card as in claim 2, wherein said second carding drum (7) is provided with fixed caps (7A).

* * * * *